US006398575B1

(12) United States Patent
Bresson

(10) Patent No.: US 6,398,575 B1
(45) Date of Patent: Jun. 4, 2002

(54) LOCKING DEVICE FOR ELECTRICAL CONNECTOR

(75) Inventor: René Bresson, Sainte Honorine du Fay (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/763,201

(22) PCT Filed: Jul. 3, 2000

(86) PCT No.: PCT/FR00/01895

§ 371 (c)(1),
(2), (4) Date: Mar. 1, 2001

(87) PCT Pub. No.: WO01/03250

PCT Pub. Date: Jan. 11, 2001

(30) Foreign Application Priority Data

Jul. 6, 1999 (FR) ..... 99 09027

(51) Int. Cl.[7] ..... H01R 13/627
(52) U.S. Cl. ..... 439/352; 439/357
(58) Field of Search ..... 439/350, 352, 439/357, 358

(56) References Cited

U.S. PATENT DOCUMENTS 3,569,903 A * 3/1971 Brishka
4,711,507 A 12/1987 Noorily
4,880,393 A 11/1989 Moji
5,779,495 A * 7/1998 Dechelette ..... 439/353
5,895,284 A 4/1999 Kocher et al.
5,915,987 A * 6/1999 Reed ..... 439/352

FOREIGN PATENT DOCUMENTS

GB 2243729 * 6/1991

* cited by examiner

*Primary Examiner*—Khiem Nguyen
(74) *Attorney, Agent, or Firm*—Oliff & Berridge, PLC

(57) ABSTRACT

A part of an electrical connector including, a body, at least one elastic arm which has at least one locking hook attached to the body and extending laterally to the body, the elastic arm being flexible from a locking position wherein the arm is unstressed and close to the body to an unlocking position wherein the arm is stressed and bent away from the body, a slide comprising a window through which passes the elastic arm carrying the hook and wherein the slide slides on the body of the connector between a locking position and an unlocking position and a ramp provided between the slide and the elastic arm so that as the slide moves from the locking position to the unlocking position, the slide acts on the elastic arm to bend the arm and the hook away from the body in the unlocking position.

33 Claims, 3 Drawing Sheets

LOCKING DEVICE FOR ELECTRICAL CONNECTOR

The present invention relates to a locking and unlocking device for an electrical connector.

BACKGROUND OF THE INVENTION

An electrical connector comprises a male part and a female part. To ensure a good connection between these two parts, one of the parts is locked to the other. Several locking devices are known. For example, it is known to use a threaded connection, in which case a housing, for the male part, for example, comprises two tapped holes while the corresponding female part carries two screws, e.g. knurled screws.

The disadvantage with this system is that it takes some time to lock and/or unlock. The device is in addition relatively expensive.

It is also known practice to fasten one part of the connector to the other part using hooks and hook catches. The hook is on an elastic arm, which itself pivots on part of the connector. To unlock the device, pressure is applied to the free end of the pivoting arm furthest from the hook to release the latter from its hook catch. The hook catch may be a cavity formed in the other part of the connector.

The problem with this locking device is its large size, because in order to have enough leverage, the pivoting arm must be relatively long and extend beyond the body of that part of the connector to which this arm is attached.

SUMMARY OF THE INVENTION

It is therefore an object of the present invention to provide a locking and unlocking device for a connector of small size. Advantageously, this device has a relatively low cost price.

For this purpose, the device which the invention proposes is a locking device for an electrical connector with a male part and a female part, this device comprising at least one locking hook on an elastic arm attached to a first part of the connector to engage with a hook catch formed on the second part of the connector.

According to the invention, this device also comprises a slide containing a window through which passes the arm carrying the hook, said slide sliding on the first part of the connector between a locked position in which the hook and the hook catch are engaged and an unlocked position in which the hook is withdrawn from its hook catch, a ramp, cam or the like being provided between the slide and the elastic arm so that as it moves from the locked position to the unlocked position, the slide acts on the elastic arm, to move the hook away from its hook catch.

In order to lock the device, all that is required is to push the male part onto the female part or vice versa, the locking device being in the locked position. For unlocking, the slide is operated to move from the locked position to the unlocked position. As the slide moves, its ramp pushes the hook away from its hook catch, thus freeing the male and female parts from each other.

In a first embodiment, one edge of the window slides between the elastic arm carrying the hook and the first part, and the ramp is formed on that face of the elastic arm which is nearest to the first part of the connector. In this case, a protuberance may be provided on that face of the elastic arm which is nearest to the first part of the connector, between the hook and the ramp. This protuberance enables the slide to be kept in its locked position. Furthermore, when the slide is being operated, once past the protuberance the slide is clear of that part of the connector to which it is mounted and the slide can be grasped more easily to act on the elastic arms.

In a second embodiment, the elastic arm is housed entirely inside the window in the locked position, that edge of the window which is nearest to the hook is beveled on the face facing away from the first part of the connector and the free end of the elastic arm includes a complementary surface to the bevel formed on the edge of the window, in such a way that when the edge of the window slides under the hook, the latter moves away from the first part of the connector and from the hook catch.

For a better locking action, the locking device according to the invention advantageously comprises two elastic arms each carrying a hook. In this case, the two elastic arms may for example be connected by a base, thus forming a U-shaped stirrup. The stirrup is preferably formed in two parts assembled together, each part having an elastic arm. By way of example, they may be assembled by mutual engagement of the two parts or by welding. To mount this locking device on one part of the connector, the slide is positioned on the connector and then each part carrying an elastic arm is put in position. Welding, e.g. ultrasound welding, is then carried out to join the two parts of the stirrup together and also to join the stirrup to the connector part.

BRIEF DESCRIPTION OF THE DRAWINGS

However, a clear understanding of the invention will be gained from the following description, with reference to the accompanying schematic drawing, which shows by way of non-limiting examples, two embodiments of a locking device according to the invention.

DETAILED DESCRIPTION OF PREFERRED EMBODIMENTS

Figure 1:
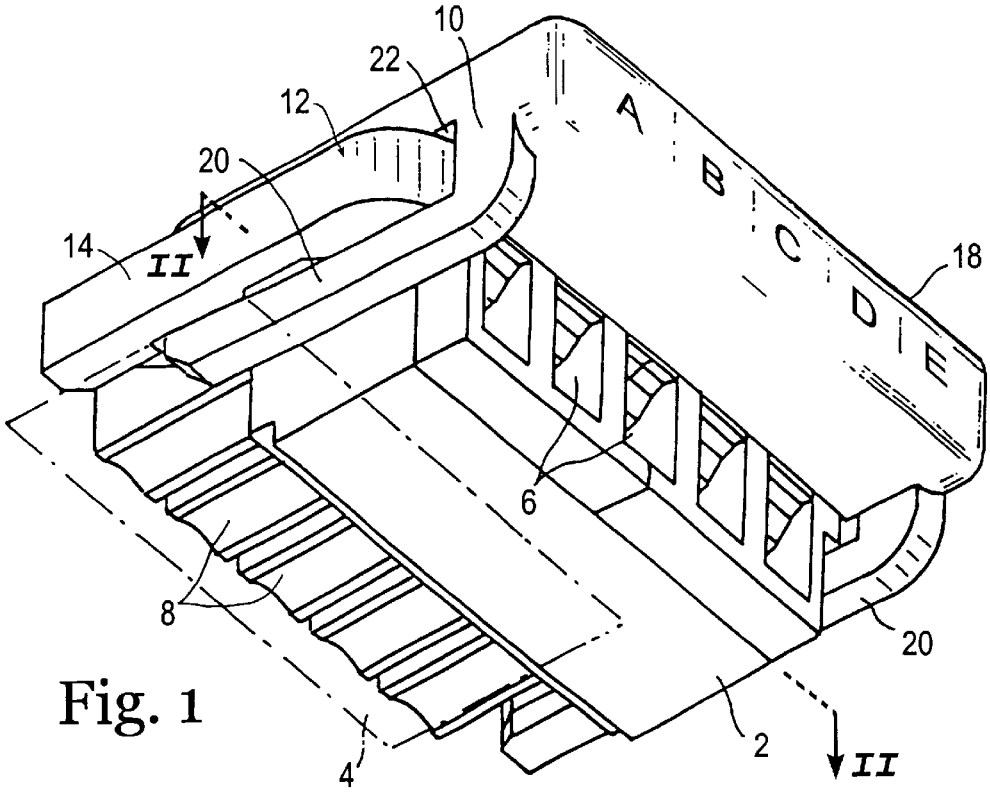
FIG. 1 is a perspective view of a female connector equipped with locking device according to the invention.

FIG. 1 shows a female part 2 of a connector. The male part 4 of this connector is represented only in outline by chain line. This connector comprises five pins and visible in FIG. 1 are five entrances 6 each designed to take one wire. These five entrances 6 are aligned with each other, and to each of them there corresponds, on the opposite side of the female part 2 from the entrances 6, a contact 8. Consequently there are thus five contacts 8 aligned with each other.

The female part 2 of the connector is provided with a locking device. This device comprises two elements: a stirrup and a slide 10.

The stirrup is composed of two bent components 12. These components 12 are welded together to form a U-shaped stirrup. The base of this U is welded to the female part 2 of the connector. The branches of this stirrup each form an elastic arm 14. Each elastic arm 14 extends along the female part 2 of the connector, parallel to the contacts 8. The base of the stirrup is at the entrance 6 end, while the free ends of the elastic arms 14 are at the contact 8 end, i.e. at the end of the female part 2 designed to receive the corresponding male part 4.

On its face next to the female part 2 of the connector, each elastic arm 14 comprises a hook 16 designed to engage with a hook catch formed in the male part 4 and not shown in the drawing. This hook catch may for example be similar in shape to the hook 16 but it may also be a recess formed in the male part 4 of the connector.

The slide 10 is similarly U-shaped. It comprises a base 18 and two side branches 20. The female part 2 of the connector sits between the side branches of the slide, the base 18 now being situated at the entrance 6 end. The base 18 of the slide can for example be used for labeling the entrances 6. In FIG. 1 the first five letters of the alphabet are used for this labeling. The side branches 20 of the slide each include a window 22 through each of which passes an elastic arm 14. The free end of each side branch 20 of the slide is situated between a hook 16 and the bend of the corresponding bent component 12. This free end therefore moves between the elastic arm 14 and the female part 2 of the connector. The window 22 is an elongate window allowing the slide to be moved approximately parallel to the direction of the contacts 8. The length of the windows 22 determines the length of the travel of the slide 10. The width of this window 22 is approximately equal to the width of the corresponding elastic arm 14. Thus, each window 22 guides the slide 10 during its sliding movement by interaction with the elastic arms 14.

Figure 3:
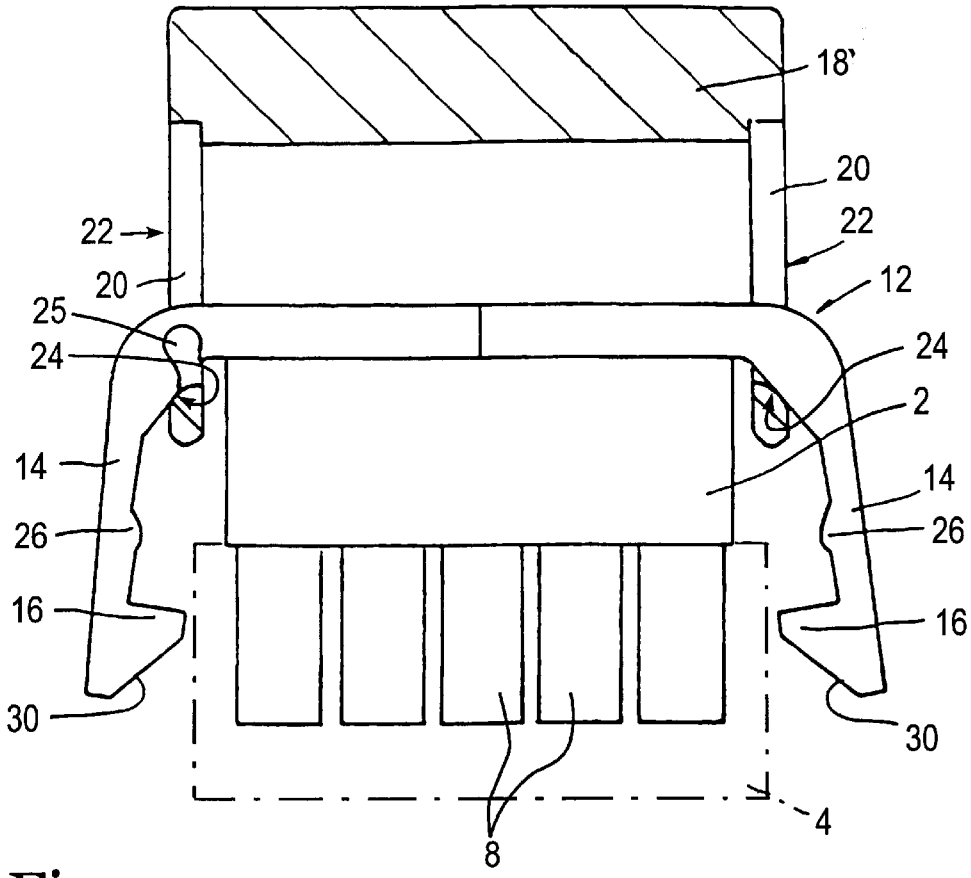
FIG. 3 is a front view of the connector of FIG. 1 in the unlocked position.

That face of the elastic arm 14 which is nearest to the female part 2 of the connector includes a ramp 24 in the vicinity of the bent component 12. This ramp creates a narrowing of the free space left between the elastic arm 14 and the female part 2 of the connector when moving away from the free ends of the elastic arms 14 toward the base of the stirrup. This face on each elastic arm 14 also includes a protuberance 26 located between the ramp 24 and the hook 16. In order not to impair the elasticity of the elastic arm 14, a recess 25 can be provided in the bend of the bent component 12, as shown on the left-hand side of FIG. 3. On that face of the elastic arm which is nearest the female part there is therefore a cam which forms the ramp 24.

To assemble this locking device, the slide 10 is first placed on the female part 2 of the connector. The bent components 12 are then positioned by inserting them through the windows 22. The two bent components 12 are then welded together, for example by ultrasound welding, and the resulting stirrup is welded to the female part 2 of the connector.

Figure 2:
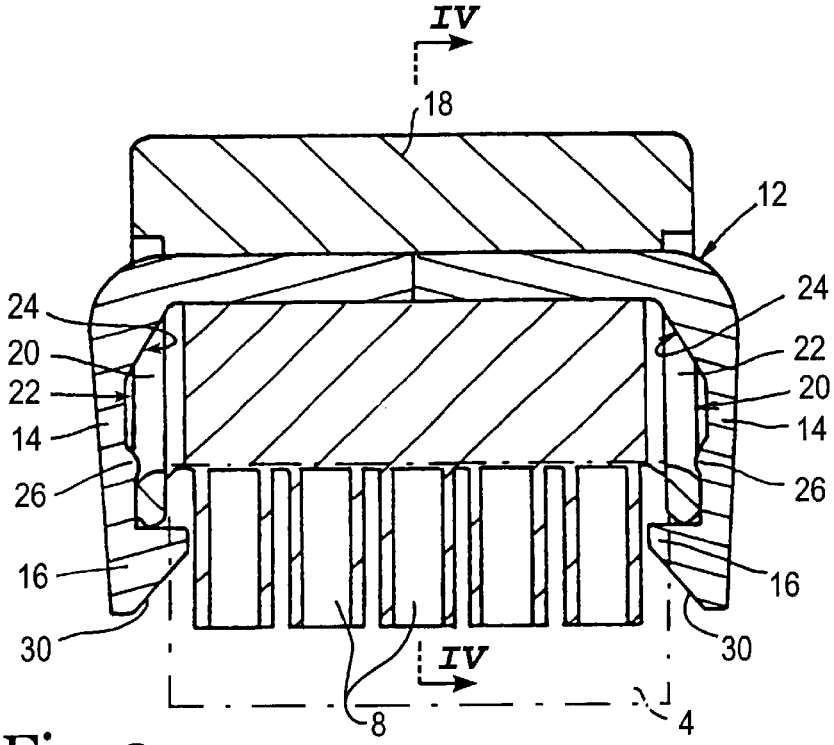
FIG. 2 is a longitudinal sectional view on cutting plane II—II as marked in FIG. 1.
Figure 4:
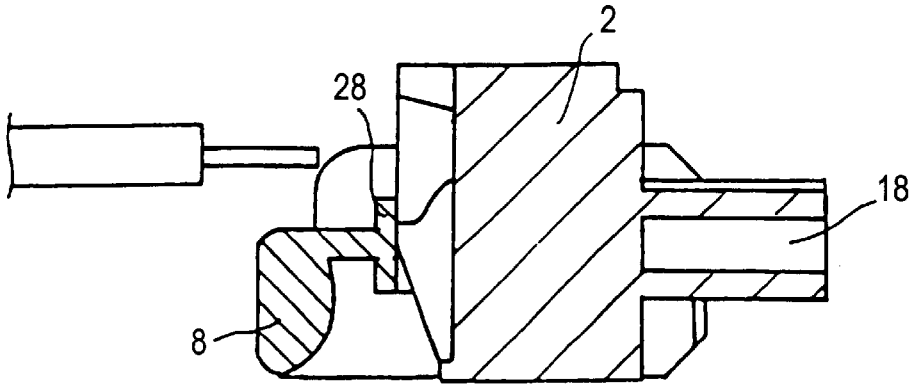
FIG. 4 is a sectional view on the plane IV—IV as marked in FIG. 2.

The operation of this locking device is therefore as follows: in the locked position (FIGS. 1 and 2), the slide 10 is pushed in so that its base 18 is resting against that face of the female part 2 that includes the entrances 6. The free end of each side branch 20 of the slide is close to the hooks 16. To ensure that pressure on the base 18 of the slide does not cause the branches 20 to move the hooks 16, an end stop 28 is provided on that face of the female part 2 which contains the entrances 6 (FIG. 4). The protuberances 26 are at the edge of the corresponding windows 22, toward the free ends of the side branches 20. They enable the slide to be kept in its locked position. The female part 2 can thus be clicked onto the male part 4. The free end of each elastic arm 14 has a chamfer 30 facing towards the female part 2 of the connector for easier snap engagement.

Once the female part 2 is in place on the male part 4, unlocking is effected by pulling on the base 18 of the slide 10. The base 18 is then moved away from that face of the female part in which the entrances 6 are formed. The side branches 20 of the slide then slide alongside the female part 2 of the connector. The protuberances 26 create an initial slide obstacle. As the free ends of the side branches pass over these protuberances 26, the elastic arms 14 are pushed slightly away from the female part 2 of the connector without actually disengaging the hooks 16 from their hook catches. Once the slide obstacle has been overcome, the base 18 of the slide will be found to have come away from that face of the female part 2 of the connector in which the entrances 6 are formed. It is now possible to grasp the base 18 of the slide from the rear, so it can now be pulled more easily. As the pulling movement continues, the free ends of the side branches 20 reach the ramps 24. As the pulling action continues, the elastic arms come away from the female part 2 of the connector and the hooks 16 are no longer engaged with the corresponding hook catches. The connector is thus unlocked.

Figure 5:
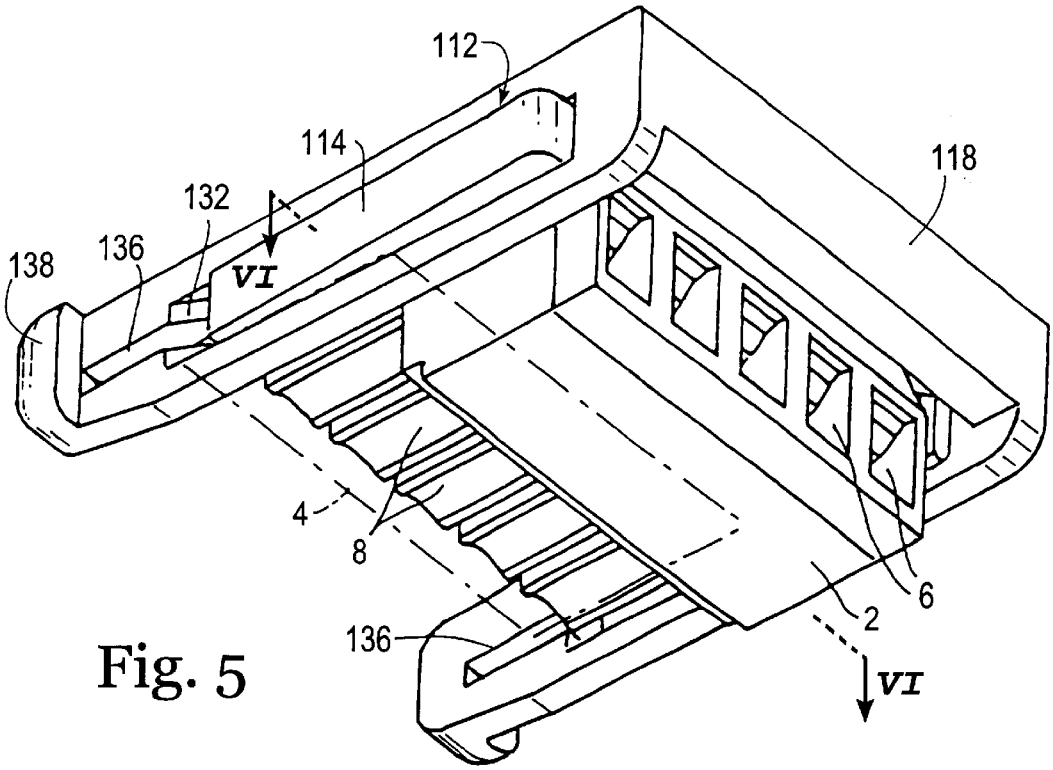
FIG. 5 is a perspective view of a female part of a connector equipped with an alternative embodiment of a locking device according to the invention.
Figure 6:
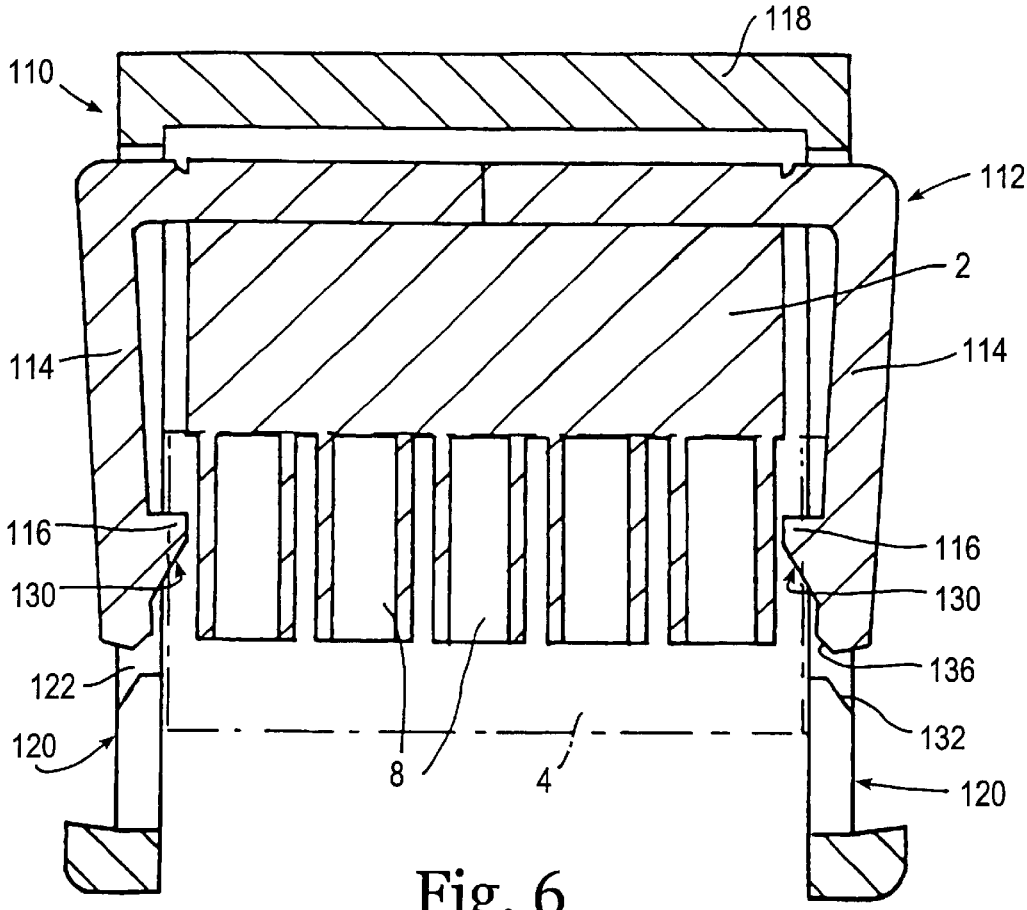
FIG. 6 is a sectional view on VI—VI as marked in FIG. 5.

FIGS. 5 and 6 show another embodiment of a locking device designed for the female part 2 shown in FIGS. 1 to 4. Entrances 6 and contacts 8 therefore appear here also.

The locking device presents a similar structure to that described previously: as before, there is a slide 110 and a stirrup made up of two bent components 112. The stirrup and the slide 110 are likewise U-shaped and are arranged relative to the female part of the connector in the same way as in the first embodiment. Each bent component comprises an elastic arm 114 extending alongside the female part 2 in the same direction as the contacts 8. At the end of each elastic arm 114 is a hook 116 facing toward the female part 2 of the connector. The slide 110 comprises a base 118 and two side branches 120. A window 122 is formed in each of the side branches 120.

The differences between this second embodiment and the first embodiment as described above relate primarily to the side branches 120 and the elastic arms 114 of the locking device. When the device is in the locked position, each window 122 accommodates the corresponding elastic arm 114 entirely. A ramp 132 is formed on that edge of the window 122 furthest from the base 118 of the slide. This ramp 132 is formed on the outer face of the corresponding side branch 120. The free end of the elastic arm 114 is in turn provided with an opposing ramp 136 formed on the side facing towards the female component 2.

Each window 122 is continued by a slot 136 toward the free end of the corresponding side branch 120. The purpose of this slot 136 is to allow the corresponding hook 116 to pass along it when the slide is pulled from its locked position to its unlocked position. An end stop 138 is provided at the end of each side branch 120 to limit the travel of the slide 110.

The way this locking device works is almost exactly the same as for the first locking device described earlier. In the locked position, the base 118 of the slide 110 is up against that face of the female part in which the entrances 6 are formed. Engaging the female part on the male part occurs in exactly the same way. As before, a chamfer 130 on the hooks 116 facilitates the snap engagement of the hooks 116 on the corresponding hook catches. The device is locked simply by clicking the female part 2 onto the corresponding male part 4, the locking device being in the locked position in the course of this operation.

Unlocking is done by pulling the base 118 of the slide 110 away from the female part 2 of the connector. The ramps 132 of the side branches 120 act on the opposing ramps 134 of the elastic arms 114 to push them away from the female part 2 of the connector. When the slide 110 has been pulled as far as it will go, the free ends of the elastic arms 114 are in abutment against the end stops 138 at the free ends of the side branches 120.

It goes without saying that the invention is not limited to the two embodiments described above by way of non-limiting examples; on the contrary, it encompasses all variants within the scope of the following claims.

For instance, the two examples above show two positions for the ramps that enable the elastic arms to be pushed out. Other positions could be envisaged for this ramp, such as for example in the middle of the elastic arms.

The elastic arms here constitute the branches of a U-shaped stirrup. It would be possible to have independent elastic arms fixed directly to the female part of the connector.

The locking devices described above are mounted on a female part of a connector. The devices according to the invention are also adaptable to male parts of a connector.

What is claimed is:

1. A part of an electrical connector, the part comprising:

a body;

at least one elastic arm which has at least one locking hook attached to the body and extending laterally to the body, the elastic arm being flexible from a locking position wherein the arm is unstressed and close to the body to an unlocking position wherein the arm is stressed and bent away from the body;

a slide comprising a window through which passes the elastic arm carrying the hook, wherein the slide slides on the body of the connector between a locking position and an unlocking position; and ramp means provided between the slide and the elastic arm so that as the slide moves from the locking position to the unlocking position, the slide acts on the elastic arm to bend the arm and the hook away from the body in the unlocking position.

2. The part of an electrical connector as claimed in claim 1, wherein one edge of the window slides between the elastic arm carrying the hook and the body and the ramp is formed on a face of the elastic arm which is nearest to the body.

3. The part of an electrical connector as claimed in claim 2, wherein a protuberance is provided on the face of the elastic arm which is nearest to the body, between the hook and the ramp.

4. The part of an electrical connector as claimed in claim 1, wherein in the locking position, the elastic arm is housed entirely inside the window, the edge of the window which is nearest to the hook is beveled on the face facing away from the body of the connector and the free end of the elastic arm comprises a complementary surface to the bevel formed on the edge of the window, in such a way that when the edge of the window slides under the hook, the hook moves away from the body of the connector and the elastic arm is bent away from the body of the connector.

5. The part of an electrical connector as claimed in claim 1, comprising two elastic arms each carrying a hook.

6. The part of an electrical connector as claimed in claim 5, wherein the two elastic arms are connected by a base, thus forming a U-shaped stirrup.

7. The part of an electrical connector as claimed in claim 6, wherein the stirrup is formed in two elements assembled together, each element having an elastic arm.

8. The part of an electrical connector as claimed in claim 1, wherein the slide in the locking position does not jam the bending of the elastic arm.

9. The part of an electrical connector as claimed in claim 4, wherein the slide in the locking position does not jam the bending of the elastic arm.

10. A part of an electrical connector, comprising:

a body;

two elastic arms each having at least one locking hook attached to the body and extending laterally to the body and each arm being flexible from a locking position wherein the arm is unstressed and close to the body to an unlocking position wherein the arm is stressed and bent away from the body;

a slide comprising two windows through which each passes an elastic arm carrying an hook, wherein the slide slides on the body of the connector between a locking position and an unlocking position; and ramp means provided between the slide and the elastic arms so that as the slide moves from the locking position to the unlocking position, the slide acts on both elastic arms to bend both of the arms away from the body in the unlocking position.

11. The part of an electrical connector as claimed in claim 10, wherein one edge of each window slides between the body and the corresponding elastic arm carrying the hook and the ramps are formed on a face of the each elastic arm which is nearest to the body of the connector.

12. The part of an electrical connector as claimed in claim 11, wherein a protuberance is provided on the face of both elastic arm which is nearest to the body of the connector, between the hook and the ramp.

13. The part of an electrical connector as claimed in claim 10, wherein in the locking position, the elastic arms are housed entirely inside their corresponding window, the edge of each window which is nearest to the corresponding hook is beveled on the face facing away from the body of the connector and the free end of each elastic arm comprises a complementary surface to the bevel formed on the edge of the corresponding window in such a way that, when the edge of the window slides under the hook, the hook moves away from the body of the connector and each elastic arm is bent away from the body of the connector.

14. The part of an electrical connector as claimed in claim 10, wherein the two elastic arms are connected by a base, thus forming a U-shaped stirrup.

15. The part of an electrical connector as claimed in claim 10, wherein the stirrup is formed in two elements assembled together, each element having an elastic arm.

16. The part of an electrical connector as claimed in claim 10, wherein the slide in the locking position does not jam the bending of the elastic arms.

17. The part of an electrical connector as claimed in claim 13, wherein the slide in the locking position does no t jam the bending of the elastic arms.

18. An electrical connector, comprising:

a first part, either male or female, comprising:

a body;

at least one elastic arm which has at least one locking hook attached to the body and extending laterally to the body, the elastic arm being flexible from a locking position wherein the arm is unstressed and close to the body, to an unlocking position wherein the arm is stressed and bent away from the body;

a slide comprising a window through which passes the elastic arm carrying the hook, wherein the slide slides on the body of the connector between a locking position and an unlocking position; and ramp means provided between the slide and the elastic arm so that as the slide moves from the locking position to the unlocking position, the slide acts on the elastic arm to bend the arm and the hook away from the body in the unlocking position; and a second part, comprising a body with a hook catch for the locking hook of the first part.

19. The electrical connector as claimed in claim 18, wherein one edge of the window slides between the elastic arm carrying the hook and the body of the first part and the ramp is formed on a face of the elastic arm which is nearest to the body of the first part.

20. The electrical connector as claimed in claim 19, wherein a protuberance is provided on the face of the elastic arm which is nearest to the body of the first part, between the hook and the ramp.

21. The electrical connector as claimed in claim 18, wherein in the locking position, the elastic arm is housed entirely inside the window, the edge of the window which is nearest to the hook is beveled on the face facing away from the body of the first part and the free end of the elastic arm comprises a complementary surface to the bevel formed on the edge of the window in such a way that, when the edge of the window slides under the hook, the hook moves away from the body of the first part and the elastic arm is bent away from the body of the first part.

22. The electrical connector as claimed in claim 18, comprising two elastic arms each carrying a hook.

23. The electrical connector as claimed in claim 22, wherein the two elastic arms are connected by a base, thus forming a U-shaped stirrup.

24. The electrical connector as claimed in claim 23, wherein the stirrup is formed in two elements assembled together, each element having an elastic arm.

25. The electrical connector as claimed in claim 18, wherein the slide in the locking position does not jam the bending of the elastic arm.

26. An electrical connector, comprising:

a first part, either male or female, comprising:

a body;

two elastic arms each having at least one locking hook attached to the body and extending laterally to the body and each arm being flexible from a locking position wherein the arm is unstressed and close to the body, to an unlocking position wherein the arm is stressed and bent away from the body;

a slide comprising two windows through each passes an elastic arm carrying an hook, wherein the slide slides on the body of the connector between a locking position and an unlocking position; and ramp means provided between the slide and the elastic arms so that as the slide moves from the locking position to the unlocking position, the slide acts on both elastic arms to bend the both arms away from the body in the unlocking position; and a second part, comprising a body with two hook catches for the two locking hooks of the first part.

27. The electrical connector as claimed in claim 26, wherein one edge of each window slides between the body and the corresponding elastic arm carrying the hook and the ramps are formed on a face of the each elastic arm which is nearest to the body of the first part.

28. The electrical connector as claimed in claim 27, wherein a protuberance is provided on the face of both elastic arm which is nearest to the body of the first part, between the hook and the ramp.

29. The electrical connector as claimed in claim 26, wherein in the locking position, the elastic arms are housed entirely inside their corresponding window, the edge of each window which is nearest to the corresponding hook is beveled on the face facing away from the body of the first part and the free end of each elastic arm comprises a complementary surface to the bevel formed on the edge of the corresponding window, in such a way that when the edge of the window slides under the hook, the hook moves away from the body of the first part and each elastic arm is bent away from the body of the connector.

30. The electrical connector as claimed in claim 26, wherein the two elastic arms are connected by a base, thus forming a U-shaped stirrup.

31. The electrical connector as claimed in claim 30, wherein the stirrup is formed in two elements assembled together, each element having an elastic arm.

32. The electrical connector as claimed in claim 26, wherein the slide in the locking position does not jam the bending of the elastic arms.

33. The electrical connector as claimed in claim 29, wherein the slide in the locking position does not jam the bending of the elastic arms.

* * * * *